US006817837B2

(12) United States Patent
Hutchinson et al.

(10) Patent No.: US 6,817,837 B2
(45) Date of Patent: Nov. 16, 2004

(54) JET PUMP WITH RECIRCULATING MOTIVE FLUID

(75) Inventors: Robert J. Hutchinson, Prairieville, LA (US); Richard F. Dawson, Clinton, LA (US)

(73) Assignee: Walker-Dawson Interest, Inc., Clinton, LA (US)

( * ) Notice: Subject to any disclaimer, the term of this patent is extended or adjusted under 35 U.S.C. 154(b) by 0 days.

(21) Appl. No.: 10/199,763

(22) Filed: Jul. 19, 2002

(65) Prior Publication Data

US 2004/0013535 A1 Jan. 22, 2004

(51) Int. Cl.[7] ..... F04B 23/04; F04B 5/00

(52) U.S. Cl. ..... 417/77; 417/76; 417/151; 417/173; 417/174

(58) Field of Search ..... 417/76, 77, 84, 417/151, 173, 183, 174, 197

(56) References Cited

U.S. PATENT DOCUMENTS

| | | | | |
|---|---|---|---|---|
| 86,152 A | | 1/1869 | Hancock | |
| 137,507 A | | 4/1873 | Thayer | |
| 250,073 A | | 11/1881 | Hudson | |
| 368,691 A | | 8/1887 | See | |
| 436,932 A | | 9/1890 | Best | |
| 550,244 A | | 11/1895 | Blagburn | |
| 640,463 A | | 1/1900 | Gildea | |
| 694,002 A | | 2/1902 | Davis | |
| 900,814 A | * | 10/1908 | Wilson | 417/71 |
| 1,327,294 A | * | 1/1920 | Scanes | 417/77 |
| 1,484,345 A | * | 2/1924 | Stoelting | 417/151 |
| 2,044,088 A | | 6/1936 | Lord | |
| 2,191,424 A | | 2/1940 | Cardinal | |
| 2,196,859 A | | 4/1940 | Godfrey | |
| 2,452,421 A | * | 10/1948 | Ames | 417/77 |
| 2,524,703 A | * | 10/1950 | Hartman | 417/77 |
| 2,616,614 A | | 11/1952 | Plummer, Jr. | |
| 2,632,597 A | | 3/1953 | Boeckeler | |
| 2,702,664 A | | 2/1955 | Pienaar | |
| 3,877,238 A | | 4/1975 | Chang et al. | |
| 3,922,112 A | | 11/1975 | Miscovich | |
| 4,165,571 A | | 8/1979 | Chang et al. | |

(List continued on next page.)

FOREIGN PATENT DOCUMENTS

| | | |
|---|---|---|
| EP | 0178873 A1 | 4/1986 |
| EP | 0555984 A1 | 8/1993 |
| EP | 0882480 A1 | 12/1998 |
| EP | 1179643 A2 | 2/2002 |
| GB | 122278 | 1/1919 |
| JP | 5442682 | 12/1979 |
| JP | 3151422 | 6/1991 |
| JP | 5245355 | 9/1993 |
| JP | 08028500 | 1/1996 |

*Primary Examiner*—Justine R. Yu
*Assistant Examiner*—Timothy P. Solak
(74) *Attorney, Agent, or Firm*—Sieberth & Patty, L.L.C.

(57) ABSTRACT

A recirculating liquid jet pump for moving a wide variety of materials is described. The pump is preferably equipped with an intermediate collection reservoir enabling the placement of material to be suctioned into the collection reservoir without bringing together the material to be suctioned with the motive fluid of the liquid jet pump. The collection reservoir may also be connected to a separate container for de-watering solid-liquid mixtures to enable mixture liquid to be separated from the solids without bringing the separated liquid into contact with the motive fluid of the jet pump and without the use of excessive amounts of jet pump motive fluid.

41 Claims, 3 Drawing Sheets

U.S. PATENT DOCUMENTS

| | | | | |
|---|---|---|---|---|
| 4,186,772 | A | | 2/1980 | Handleman |
| 4,316,680 | A | | 2/1982 | Phipps et al. |
| RE31,592 | E | | 5/1984 | Heilenz |
| 4,681,372 | A | | 7/1987 | McClure |
| 4,867,877 | A | | 9/1989 | Hansen et al. |
| 5,012,984 | A | | 5/1991 | Ishikawa et al. |
| 5,182,017 | A | | 1/1993 | Ippendorf |
| 5,478,209 | A | | 12/1995 | McDonough |
| 5,522,419 | A | | 6/1996 | Sand |
| 5,628,623 | A | | 5/1997 | Skaggs |
| 5,667,365 | A | | 9/1997 | Miller et al. |
| 5,811,013 | A | | 9/1998 | Ito |
| 5,938,408 | A | | 8/1999 | Krichbaum |
| 5,957,665 | A | | 9/1999 | Kanzler et al. |
| 5,993,167 | A | * | 11/1999 | Mochizuki ..... 417/174 |
| 6,017,195 | A | | 1/2000 | Skaggs |
| 6,248,154 | B1 | * | 6/2001 | Popov ..... 95/156 |
| 6,251,167 | B1 | | 6/2001 | Berson |
| 6,322,327 | B1 | | 11/2001 | Dawson et al. |
| 6,395,167 | B1 | | 5/2002 | Mattson, Jr. et al. |

* cited by examiner

JET PUMP WITH RECIRCULATING MOTIVE FLUID

REFERENCE TO RELATED APPLICATION

This application may be considered related to commonly owned and U.S. patent application Ser. No. 09/711,499, filed on Nov. 13, 2000, now U.S. Pat. No. 6,450,725, which is a continuation-in-part of U.S. patent application Ser. No. 09/482,995, now U.S. Pat. No. 6,322,327 B1, issued on Nov. 27, 2001, and to commonly owned U.S. patent application Ser. No. 10/199,777, entitled APPARATUS AND METHODS FOR SEPARATING SLURRIED MATERIAL, co-filed herewith and commonly owned U.S. patent application Ser. No. 10/199,764, entitled EXCAVATION SYSTEM EMPLOYING A JET PUMP, co-filed herewith.

FIELD OF THE INVENTION

This invention relates generally to hydraulic nonmechanical pumping devices for transferring material, and specifically, to jet pumps for moving solid, semi-solid and/or liquid materials, as well as related methods.

BACKGROUND

Our previous invention described in U.S. Pat. No. 6,322,327 B1 provides a jet pump with significantly increased vacuum efficiency, resulting in the ability to move greater amounts of solid or slurry materials without a proportionate increase in energy consumption. While that pump configuration has made a significant contribution in the field of pump efficiency and capabilities, the material being vacuumed or suctioned in that pump configuration typically is mixed with the motive fluid of the jet pump. This can present difficulties where the material being pumped might become volatile when placed in contact with the motive fluid or when the material being pumped is preferably be kept separate from the motive fluid for other reasons. Also, our previous developments still required significant volumes of motive fluid in many commercial scale pumping operations.

Thus, a need has continued to exist for a jet pump which does not require a large volume of motive fluid in commercial operations, and which allows a user to keep pumped material separate from the motive fluid of the jet pump.

SUMMARY OF THE INVENTION

The present invention meets these and other needs by providing, among other things, apparatus comprising:

(a) a jet pump in fluid communication with a passageway for a material to be suctioned, the jet pump being sized and configured to create a vacuum in the passageway when the jet pump is in use;

(b) a motive fluid pump sized and configured to supply a motive fluid to the jet pump; and (c) a motive fluid reservoir downstream from the jet pump, the motive fluid reservoir being in fluid communication with the jet pump and the motive fluid pump so that during use the motive fluid pump recirculates at least a portion of the motive fluid from the motive fluid reservoir to the jet pump;

wherein the jet pump is comprised of a nozzle assembly which is sized and configured to (A) receive the motive fluid and a gas, and (B) eject the motive fluid as a liquid flow while feeding the gas into proximity with the periphery of the liquid flow. Preferably, the jet pump in apparatus of this invention is further comprised of a housing defining a suction chamber into which the nozzle assembly may eject the liquid flow, the housing further defining a suction inlet and a suction outlet; and an outlet pipe extending from the suction outlet away from the suction chamber, the outlet pipe being in fluid communication with the suction chamber and being disposed to receive the liquid flow; the outlet pipe defining at least a first inner diameter along a portion of its length and a second inner diameter along another portion of its length, the second inner diameter being less than the first inner diameter. It is particularly preferred in certain applications that the nozzle assembly extend into the suction chamber towards the suction outlet and into the imaginary line of flow of the suction pipe.

In another embodiment of the invention, the apparatus further comprises a material collection reservoir which is sized and configured to permit the formation of a vacuum therein. In this embodiment, the collection reservoir is intermediate to, and in fluid communication with, the passageway for the material to be suctioned and the jet pump. This collection reservoir allows material which is suctioned to be collected without mixing with or otherwise contacting the motive fluid of the jet pump.

Yet another embodiment of this invention provides a method of moving material from one location to another. The method comprises:

a. injecting a pressurized fluid into a nozzle assembly to produce a flow of pressurized fluid, b. providing a gas to the nozzle assembly to surround the flow of pressurized fluid with the gas, c. directing the flow of pressurized fluid surrounded by the gas into a suction chamber which defines both an inlet in fluid communication with a collection reservoir and an outlet in fluid communication with an outlet pipe, the outlet pipe defining a venturi-like inner surface, and directing the flow of pressurized fluid surrounded by the gas into the outlet pipe to produce a vacuum in the collection reservoir, d. suctioning the material to be moved into the collection reservoir using the vacuum produced in step (c.), and e. recirculating at least a portion of the pressurized fluid directed into the outlet pipe back into the nozzle assembly.

In a preferred embodiment of this invention, the material to be moved is liquid material from a slurry comprised of a mixture of solid material and liquid material. The suctioning of step (d.) is carried out after placing the collection reservoir in fluid communication with a slurry container and equipped with a filter so that, when a vacuum is created in the collection reservoir, a vacuum is created in the slurry container and liquid material from slurry within the slurry container is suctioned through the filter and into the collection reservoir while solid material remains in the slurry container. This preferred embodiment thus enables the removal of liquid from the slurry without mixing or otherwise bringing together the separated liquid material with the motive fluid of the jet pump. In another preferred embodiment of this invention, the method further comprises the step of controlling the flow rate of the gas into the nozzle assembly to thereby control the level of vacuum produced in the suction chamber.

These and other embodiments, advantages, and features of this invention will be apparent from the following description, accompanying drawings and appended claims.

BRIEF DESCRIPTION OF THE DRAWINGS

In each of the above figures, like numerals or letters are used to refer to like or functionally like parts among the several figures.

DETAILED DESCRIPTION OF THE INVENTION

It will now be appreciated that the re-circulation of motive fluid for the jet pump component in apparatus of this invention coupled with a collection reservoir intermediate in series to the targeted material to be suctioned enables vacuum collection of the material to be moved into the collection reservoir without moving parts contacting the material and without the material contacting motive fluid of the jet pump. Thus solids, liquids, gases and all mixtures or two or more of those which are subject to being moved by a vacuum can be moved, collected and/or separated without vacuum pump contact, and the jet pump driving the vacuum is self-contained in that it only requires a fixed amount of motive fluid to operate. When using the preferred jet pumps of this invention, the foregoing can be accomplished without pump cavitation so as to maintain a stable level of vacuum during pump operation regardless of the material being suctioned.

Figure 1:
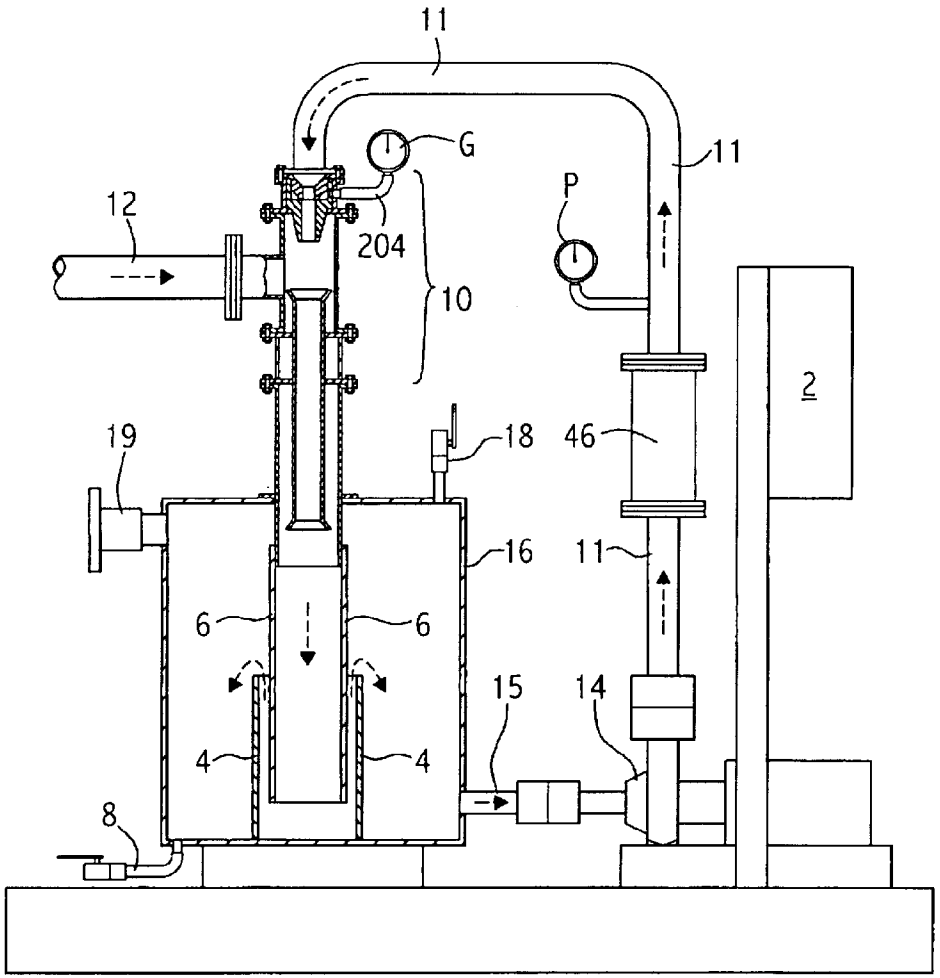
FIG. 1 is a partial cross-sectional, side view of a preferred embodiment of the present invention.

Turning now to the drawings, FIG. 1 illustrates one preferred embodiment of this invention. There, a re-circulating jet pump apparatus is shown to include a jet pump 10, a pipe 12 which defines a passageway in fluid communication with pump 10, a motive fluid pump 14, a motive fluid reservoir 16, and a heat exchanger 46. Pump 14 is an electrical centrifugal pump controlled at an electrical control panel 2. Pump 14 forces motive fluid, e.g., liquid water or another inert fluid, into a pipe loop 11 which feeds the pressurized motive fluid into a nozzle assembly (see FIG. 3) of jet pump 10. A pressure gauge P is provided to allow monitoring of the motive fluid pressure. Loop 11 places the re-circulating motive fluid in thermal communication with heat exchanger 46 by directing the motive fluid through exchanger 46 to remove accumulated heat from the motive fluid during its re-circulation.

The motive fluid reservoir 16 further comprises a drain valve 8, a breather valve 18 and an exhaust port 19. Valve 18 and port 19 exhaust gas built up in reservoir 16 during use of the vacuum created by jet pump 10, in order to maintain a level of motive fluid in reservoir 16 sufficient to feed a pipe 15 at the lower portion of reservoir 16. Pipe 15 in turn feeds motive fluid to motive fluid pump 14. Reservoir 16 further comprises vertical baffles 4 and 6 for diverting the flow of a mixture of motive fluid and gas suctioned into and expelled out of jet pump 10. By diverting the flow in this way, baffles 4 and 6 facilitate the separation of liquid from gas within reservoir 16 to minimize gas in the motive fluid exiting reservoir 16 at pipe 15. This in turn minimizes the amount of gas fed into pump 14. While this configuration of the motive fluid reservoir is preferred, other reservoir configurations or labyrinth-like structures may be employed so long as the configuration minimizes the amount of gas transferred from the motive fluid reservoir to the motive fluid pump.

Figure 2:
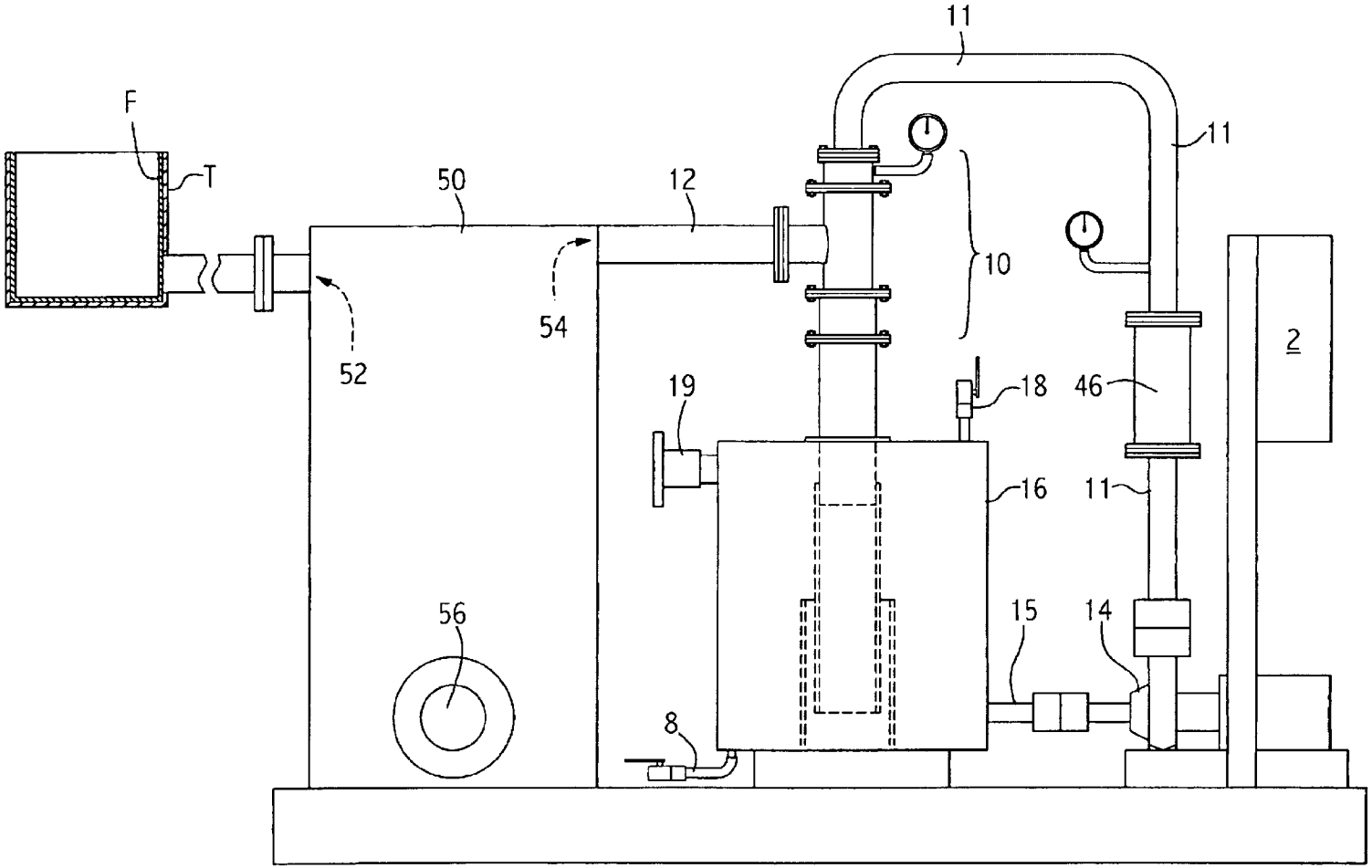
FIG. 2 is a side view of another preferred embodiment of the present invention.

As seen in another preferred embodiment illustrated in FIG. 2, the apparatus of FIG. 1 is placed in fluid communication with a material collection reservoir 50. Collection reservoir 50 defines a collection reservoir inlet 52 through which suctioned material enters reservoir 50. In the particular embodiment depicted, the material enters inlet 52 from a slurry container T which is in fluid communication with reservoir 50 through inlet 52 and is lined with a filter F. As a vacuum is created in reservoir 50, the fluid communication between reservoir 50 and container T causes a vacuum to be formed in container T to draw liquid material from slurry therein through filter F and into material collection reservoir 50. This particular de-watering configuration is more particularly described in our co-filed and commonly owned U.S. patent application Ser. No. 10/199,777, which is fully incorporated herein by reference. A collection reservoir outlet 54 is connected to pipe 12 to place the interior of reservoir 50 in fluid communication with the passageway defined by pipe 12. A discharge port 56 at a lower portion of reservoir 50 may be closed to allow suctioned material which enters reservoir 50 to accumulate, or opened to drain reservoir 50 of suctioned material. Draining through port 56 can be facilitated during jet pump operation by placing discharge port 56 of reservoir 50 in fluid communication with another vacuum pump (not shown) to pull accumulated material from the lower portion of reservoir 50. Collection reservoir 50 should be constructed in such a way that it structurally withstands the vacuum produced by the pump(s) with which it is in fluid communication during operation of the apparatus.

Figure 3:
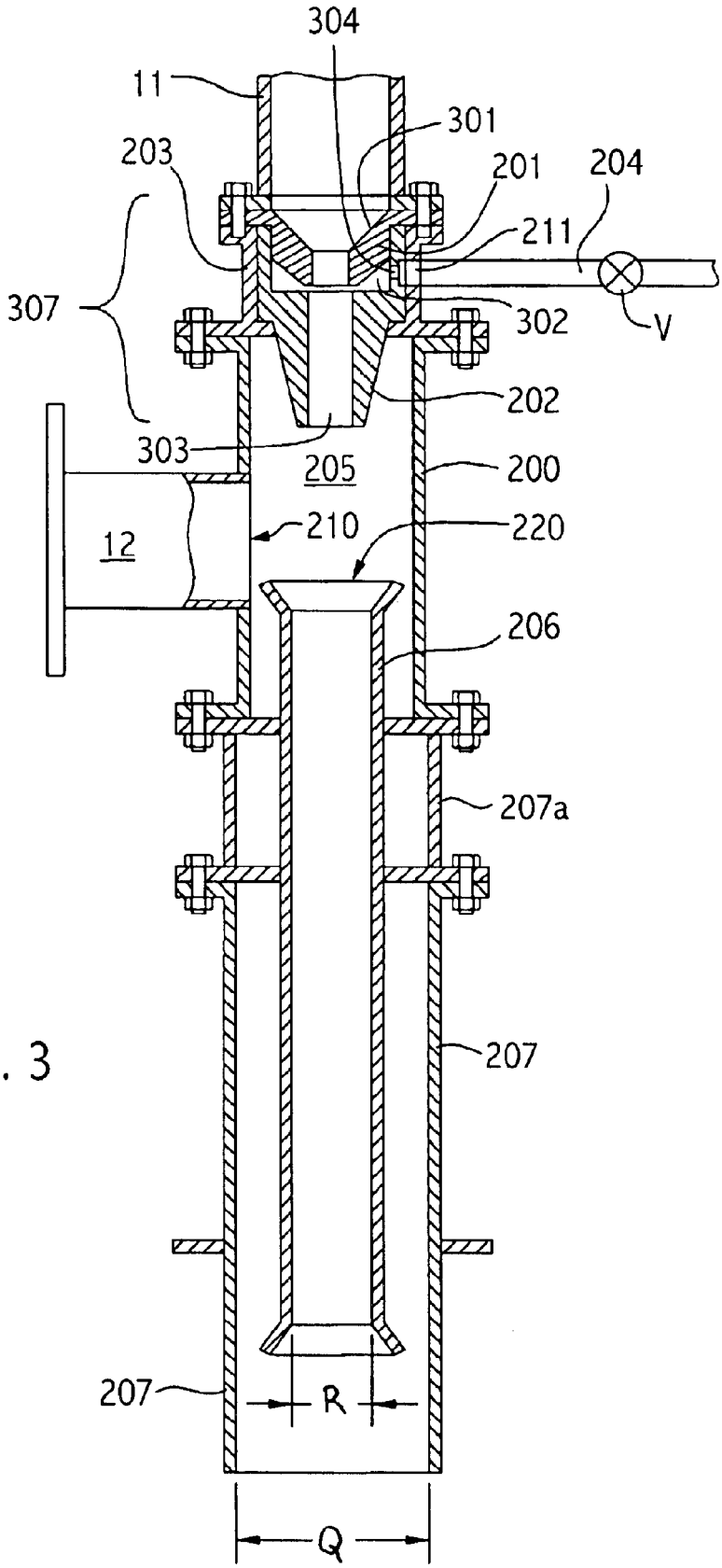
FIG. 3 is an enlarged view in cross-section of the jet pump component of the device of FIG. 1.

In the preferred embodiments depicted, the jet pump is configured in accordance with our previously developed jet pump described in commonly-owned U.S. Pat. No. 6,322,327 B1 and in our co-pending and commonly-owned U.S. patent application Ser. No. 09/711,499, both of which are entirely incorporated herein by reference. FIG. 3 illustrates in cross-section jet pump 10 of FIGS. 1 and 2. Jet pump 10 includes nozzle assembly 307, which in turn is comprised of a constricted throat 301 formed by fluid nozzle 201, an air injection nozzle 202 which forms a nozzle opening 303, and a nozzle housing 203. Nozzle housing 203 is a flanged member which is attached to and maintains the proper position of fluid nozzle 201 adjacent to air injection nozzle 202. Air intake 211 is a passage through nozzle housing 203. In the embodiment depicted, a single air intake 211 is shown although a plurality of intakes also may be provided. A gas conduit in the form of an air hose 204 allows a gas to enter jet pump 10 through intake 211. The gas enters the nozzle assembly through intake 211 and an aperture 304 in nozzle 202, then into an annular air gap 302 to form an air bearing around fluid flow ejected from nozzle 201 as the gas passing through gap 302 between the tip of nozzle 201 and the upstream side of nozzle 202. The amount of gas allowed into jet pump 10 is controlled by a valve V which includes a gauge G (FIG. 1). By using valve V to control the level of gas entering jet pump 10, it is possible to increase or decrease the level of vacuum produced by jet pump 10.

Water or other motive fluid from loop pipe 11 passes through fluid nozzle 201 and air injection nozzle 202 of nozzle assembly 307 and into a housing 200 which defines a suction chamber 205, a suction inlet 210 and a suction outlet 220. In suction chamber 205, the fluid in the form of a liquid flow combines with gas or gaseous material entering from pipe 12 through inlet 210, and the combined stream enters an outlet pipe 207 through outlet 220, pipe 207 being comprised of an outlet pipe segment 207*a* which is detachable from the apparatus and which itself comprises a concentric wear segment in the form of a venturi target tube 206. The combined stream then passes through target tube 206 into outlet pipe 207 and into motive fluid reservoir 16.

Although not depicted in these drawings and typically less important when the material being suctioned does not include solid material, the nozzle assembly 307, and in particular the downstream end of air injection nozzle 202 may be extended into suction chamber 205 and into an imaginary line of flow of material from pipe 12 through suction inlet 210 to increase the vacuum created by jet pump 10. This feature is more particularly described in the previously referenced U.S. Pat. No. 6,322,327 B1 and U.S. patent application Ser. No. 09/711,499.

Outlet pipe 207 defines a first inner diameter Q, and target tube 206 defines a second inner diameter R which is less than inner diameter Q. It should be appreciated that outlet pipes of this invention may also be fabricated without a target tube but with a non-uniform inner surface so as to define a narrowing passage providing a venturi-like effect to the material exiting the suction chamber through the outlet pipe.

The gas employed in the jet pump component of preferred embodiments of this invention will preferably be under no more than atmospheric pressure, to reduce risk of operations and cost. The gas preferably will be an inert gas, e.g., nitrogen or argon, when the liquid or other material being pumped could be volatile in the presence of certain atmospheric gases, e.g., oxygen. When such volatility is not an issue, the gas employed will be most conveniently atmospheric air.

Typically, as depicted, the motive fluid pump is an electrically powered centrifugal pump or the like. However, the motive fluid pump alternatively may be any pump that is otherwise compatible with the motive fluid being pumped and is otherwise capable of causing the motive fluid to re-circulate back into the jet pump sufficiently to cause the jet pump to form a vacuum. The motive fluid of this invention may be any fluid which is capable of being used in the jet pump to create a vacuum. Typically, the motive fluid will be liquid water or some other aqueous liquid solution, but the motive fluid also may be a gas or another liquid if the circumstances of use dictate that water is less preferred as the motive fluid. Preferably, the motive fluid is inert to the material being moved or suctioned, to reduce hazardous condition risks in the event that the motive fluid comes into contact with the suctioned material.

The heat exchanger in preferred embodiments of this invention may be any device which reduces the temperature of the motive fluid of the jet pump, and its location along the re-circulation path of the motive fluid may vary. The heat exchanger may, for example, be a set of copper coils located along the piping which extends from the motive fluid pump to the nozzle assembly of the jet pump. Or, it could be located within or attached to the motive fluid reservoir. The location and configuration of the heat exchanger may vary as long as the heat exchanger reduces the temperature of the motive fluid during use.

While it is understood that at least one preferred jet pump described herein is characterized by certain component features, the foregoing description of specific embodiments can be readily adapted for various applications without departing from the general concept or spirit of this invention. Thus, for example, the inner surface of the outlet pipe (which provides the venturi effect feature of the outlet pipe) alternatively can be defined by the pipe itself, rather than a detachable wear plate. These and other adaptions and modifications are intended to be comprehended within the range of equivalents of the presently disclosed embodiments. Also, while specific embodiments have been described above, several other applications and embodiments of the presently described invention may be contemplated in view of this disclosure. Thus, for example, while the accompanying drawings illustrate the pumping system of this invention as used for separating liquid material from a slurry, the system may be used for virtually any application in which liquids, solids as agglomerate or particulate matter, or a slurry comprised of a mixture of liquid and solid material, must be separated or moved from one location to another. The system also may be employed to remove liquids from such slurry mixtures, thereby permitting solid particulate matter to be rapidly separated from the liquid and dried, if desired. In each of the above examples, small batch operations as well as large commercial batch, semi-continuous and continuous operations are possible using pumping methods and systems of this invention. The present invention can be used in any application requiring significant suction effect of solid material in a liquid or gaseous environment. The invention can also be used for suction in gaseous or liquid environments without solids present, and maintain a significant suction effect. Thus, as noted extensively herein, the invention can also be used in closed loop de-watering applications to remove excess water or moisture from material.

The dimensions of the various component parts of, the pressure under which motive fluid is fed to the jet pump of, and the level of vacuum produced by, devices of this invention may vary depending upon the circumstances in which the device will be employed, so long as the dimensions, pressures and vacuum permit the apparatus to function as described. Except where specifically noted otherwise herein, the component parts may be fabricated from a wide variety of materials, the selection of which will depend again upon the circumstances in which the device will be employed. Preferably, metals, metal alloys or resilient plastics, for example, will be employed to insure that points of mechanical contact or abrasive wear in the systems and pumps will be resilient enough to withstand the forces placed upon them during pump operation.

It also should be appreciated that virtually any material which can be suctioned or vacuumed can serve as the material to be moved in the practice of this invention. Thus, for example, agricultural products, liquid products or side-products, liquid waste, slurries of waste and mixtures of liquids and solids can all be suctioned using the apparatus and method of this invention.

Each and every patent or printed publication referred to above is incorporated herein by reference to the fullest extent permitted as a matter of law.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

That which is claimed is:

1. Apparatus comprising:

(a) a jet pump in fluid communication with a passageway for a material to be suctioned, the jet pump being sized and configured to create a vacuum in the passageway when the jet pump is in use;

(b) a motive fluid pump sized and configured to supply a motive fluid to the jet pump; and (c) a motive fluid reservoir downstream from the jet pump, the reservoir being in fluid communication with the jet pump and the motive fluid pump so that during use the motive fluid pump recirculates at least a portion of the motive fluid through a passageway which, together with the motive fluid reservoir, the motive fluid pump and the jet pump, forms a closed loop with respect to the motive fluid;

wherein the jet pump is comprised of (1) a nozzle assembly which is sized and configured to (A) receive the motive fluid and a gas, and (B) eject the motive fluid as a fluid flow while feeding the gas into proximity with the periphery of the fluid flow.

2. Apparatus according to claim 1 wherein the jet pump is further comprised of:

(2) a housing defining a suction chamber into which the nozzle assembly is configured to eject the fluid flow as a liquid flow, the housing further defining a suction inlet and a suction outlet; and (3) an outlet pipe extending from the suction outlet away from the suction chamber, the outlet pipe being in fluid communication with the suction chamber and being disposed to receive the liquid flow; the outlet pipe defining at least a first inner diameter along a portion of its length and a second inner diameter along another portion of its length, the second inner diameter being less than the first inner diameter.

3. Apparatus according to claim 2, wherein the nozzle assembly extends into the suction chamber towards the suction outlet and into an imaginary line of flow of a suction pipe which defines the passageway and which is in fluid communication with the suction inlet.

4. Apparatus according to claim 2 wherein the nozzle assembly defines a constricted throat, an annular gap surrounding the constricted throat, at least one aperture in fluid communication with the gap, and a nozzle opening, the constricted throat terminating at the nozzle opening.

5. Apparatus according to claim 2 wherein the gas is air.

6. Apparatus according to claim 2 wherein the gas is an inert gas.

7. Apparatus according to claim 2 wherein the nozzle assembly receives the gas from a gas conduit, and wherein the gas flow rate through the gas conduit is controlled.

8. Apparatus according to claim 7 wherein the gas flow rate is controlled by a valve, to thereby control the level of vacuum produced by the jet pump.

9. Apparatus according to claim 2 wherein the outlet pipe is comprised of an outlet pipe segment, at least a portion of the outlet pipe segment defining an inner surface, at least a portion of the inner surface in turn defining the second inner diameter of the outlet pipe.

10. Apparatus according to claim 9 wherein the outlet pipe segment is detachable from the apparatus.

11. Apparatus according to claim 10 wherein the outlet pipe segment is comprised of a detachable concentric wear segment which defines the inner surface.

12. Apparatus according to claim 11 further comprising a heat exchanger in thermal communication with the motive fluid.

13. Apparatus according to claim 1 further comprising a heat exchanger in thermal communication with the motive fluid.

14. Apparatus according to claim 1 further comprising a material collection reservoir which is sized and configured to permit the formation of a vacuum therein, the collection reservoir being intermediate to, and in fluid communication with, the passageway for the material to be suctioned and the jet pump.

15. Apparatus according to claim 14 wherein the jet pump is further comprised of:

(2) a housing defining a suction chamber into which the nozzle assembly is configured to eject the fluid flow as a liquid flow, the housing further defining a suction inlet and a suction outlet; and (3) an outlet pipe extending from the suction outlet away from the suction chamber, the outlet pipe being in fluid communication with the suction chamber and being disposed to receive the liquid flow; the outlet pipe defining at least a first inner diameter along a portion of its length and a second inner diameter along another portion of its length, the second inner diameter being less than the first inner diameter.

16. Apparatus according to claim 15, wherein the nozzle assembly extends into the suction chamber towards the suction outlet and into an imaginary line of flow of a suction pipe which defines the passageway and which is in fluid communication with the suction inlet.

17. Apparatus according to claim 16 wherein the nozzle assembly defines a constricted throat, an annular gap surrounding the constricted throat, at least one aperture in fluid communication with the gap, and a nozzle opening, the constricted throat terminating at the nozzle opening.

18. Apparatus according to claim 15 wherein the gas is air.

19. Apparatus according to claim 15 wherein the gas is an inert gas.

20. Apparatus according to claim 15 wherein the nozzle assembly receives the gas from a gas conduit, and wherein the gas flow rate through the gas conduit is controlled.

21. Apparatus according to claim 20 wherein the gas flow rate is controlled by a valve, to thereby control the vacuum produced by the jet pump.

22. Apparatus according to claim 15 wherein the outlet pipe is comprised of an outlet pipe segment, at least a portion of the outlet pipe segment defining an inner surface, at least a portion of the inner surface in turn defining the second inner diameter of the outlet pipe.

23. Apparatus according to claim 22 wherein the outlet pipe segment is detachable from the apparatus.

24. Apparatus according to claim 23 wherein the outlet pipe segment is comprised of a detachable concentric wear segment which defines the inner surf ace.

25. Apparatus according to claim 24 further comprising a heat exchanger in thermal communication with the motive fluid.

26. Apparatus according to claim 14 further comprising a heat exchanger in thermal communication with the motive fluid.

27. Apparatus according to claim 15 further comprising a heat exchanger in thermal communication with the motive fluid.

28. Apparatus according to claim 1 wherein the motive fluid reservoir is configured to receive the fluid flow directly from the jet pump.

29. Apparatus according to claim 1 wherein the nozzle assembly is configured to eject the fluid flow through an outlet pipe directly into the motive fluid reservoir.

30. Apparatus according to claim 2 wherein the outlet pipe is configured to deliver the liquid flow directly into the motive fluid reservoir.

31. Apparatus according to claim 1, wherein the apparatus is configured so that the motive fluid does not contact the material to be suctioned.

32. A method of moving material from one location to another, the method comprising:

a. injecting a pressurized fluid into a nozzle assembly to produce a flow of pressurized fluid, b. providing a gas to the nozzle assembly to surround the flow of pressurized fluid with the gas, c. directing the flow of pressurized fluid surrounded by the gas into a suction chamber in fluid communication with a collection reservoir and in fluid communication with an outlet pipe, the outlet pipe defining a venturi-like inner surface, and directing the flow of pressurized fluid surrounded by the gas into the outlet pipe to produce a vacuum in the collection reservoir, d. suctioning the material to be moved into the collection reservoir using the vacuum produced in step (c.), and e. recirculating at least a portion of the pressurized fluid directed into the outlet pipe back into the nozzle assembly.

33. A method according to claim 32, further comprising the step of controlling the flow rate of the gas into the nozzle assembly to thereby control the level of vacuum produced by in the suction chamber.

34. A method according to claim 33, wherein the material to be moved is liquid material from a slurry comprised of a mixture of solid material and liquid material, and wherein the suctioning of step (d.) is carried out after placing the collection reservoir in fluid communication with a slurry container equipped with a filter so that, when a vacuum is created in the collection reservoir, a vacuum is created in the slurry container and liquid material from slurry within the slurry container is auctioned through the filter and into the collection reservoir while solid material remains in the slurry container.

35. A method according to claim 32, wherein the material to be moved is liquid material from a slurry comprised of a mixture of solid material and liquid material, and wherein the auctioning of step (d.) is carried out after placing the collection reservoir in fluid communication with a slurry container equipped with a filter so that, when a vacuum is created in the collection reservoir, a vacuum is created in the slurry container and liquid material from slurry within the slurry container is auctioned through the filter and into the collection reservoir while solid material remains in the slurry container.

36. A method according to claim 32, wherein step (e) is carried out so that the pressurized fluid is recirculated without contacting the material to be moved from one location to another.

37. Apparatus comprising:

(a) a jet pump in fluid communication with a passageway for a material to be suctioned, the jet pump being sized and configured to create a vacuum in the passageway when the jet pump is in use;

(b) a motive fluid pump sized and configured to supply a motive fluid to the jet pump;

(c) a motive fluid reservoir downstream from the jet pump, the reservoir being in fluid communication with the jet pump and the motive fluid pump so that during use the motive fluid pump recirculates at least a portion of the motive fluid from the motive fluid reservoir to the jet pump; and (d) a heat exchanger in thermal communication with the motive fluid;

wherein the jet pump is comprised of (1) a nozzle assembly which is sized and configured to (A) receive the motive fluid and a gas, and (B) eject the motive fluid as a fluid flow while feeding the gas into proximity with the periphery of the fluid flow.

38. Apparatus according to claim 37 wherein the jet pump is further comprised of:

(2) a housing defining a suction chamber into which the nozzle assembly is configured to eject the fluid flow as a liquid flow, the housing further defining a suction inlet and a suction outlet; and (3) an outlet pipe extending from the suction outlet away from the suction chamber, the outlet pipe being in fluid communication with the suction chamber and being disposed to receive the liquid flow; the outlet pipe defining at least a first inner diameter along a portion of its length and a second inner diameter along another portion of its length, the second inner diameter being less than the first inner diameter.

39. Apparatus according to claim 38 wherein the nozzle assembly receives the gas from a gas conduit, and wherein the gas flow rate through the gas conduit is controlled.

40. Apparatus according to claim 37 further comprising a material collection reservoir which is sized and configured to permit the formation of a vacuum therein, the collection reservoir being intermediate to, and in fluid communication with, the passageway for the material to be suctioned and the jet pump.

41. Apparatus according to claim 40 wherein the jet pump is further comprised of:

(2) a housing defining a suction chamber into which the nozzle assembly is configured to eject the fluid flow as a liquid flow, the housing further defining a suction inlet and a suction outlet; and (3) an outlet pipe extending from the suction outlet away from the suction chamber, the outlet pipe being in fluid communication with the suction chamber and being disposed to receive the liquid flow; the outlet pipe defining at least a first inner diameter along a portion of its length and a second inner diameter along another portion of its length, the second inner diameter being less than the first inner diameter.

* * * * *